US008683634B2

(12) United States Patent
Provost

(10) Patent No.: US 8,683,634 B2
(45) Date of Patent: Apr. 1, 2014

(54) ESCAPE RAMP

(75) Inventor: Christian Provost, Couddes (FR)

(73) Assignee: Barat (FR)

( * ) Notice: Subject to any disclaimer, the term of this patent is extended or adjusted under 35 U.S.C. 154(b) by 0 days.

(21) Appl. No.: 13/382,610

(22) PCT Filed: Jul. 7, 2010

(86) PCT No.: PCT/IB2010/053110
§ 371 (c)(1),
(2), (4) Date: Jan. 6, 2012

(87) PCT Pub. No.: WO2011/004331
PCT Pub. Date: Jan. 13, 2011

(65) Prior Publication Data

US 2012/0110754 A1 May 10, 2012

(30) Foreign Application Priority Data

Jul. 9, 2009 (FR) ..... 09 03397

(51) Int. Cl.
*E01D 1/00* (2006.01)
*B61D 1/00* (2006.01)

(52) U.S. Cl.
USPC ..... 14/71.1; 105/348

(58) Field of Classification Search
USPC ..... 14/69.5, 71.1; 414/921, 537; 105/438, 105/348; 182/42, 48
See application file for complete search history.

(56) References Cited

U.S. PATENT DOCUMENTS

| | | | | |
|---|---|---|---|---|
| 4,068,770 | A * | 1/1978 | Boehringer | 414/537 |
| 4,339,224 | A * | 7/1982 | Lamb | 414/501 |
| 4,879,843 | A * | 11/1989 | Hamamoto et al. | 49/158 |
| 6,470,523 | B1 * | 10/2002 | Sardonico | 14/71.1 |
| 2007/0183879 | A1 * | 8/2007 | Corcuera | 414/546 |
| 2012/0279417 | A1 * | 11/2012 | Charbonneau et al. | 105/348 |

FOREIGN PATENT DOCUMENTS

EP 0776808 A1 6/1997

* cited by examiner

*Primary Examiner* — Robert Pezzuto
*Assistant Examiner* — Abigail A Risic
(74) *Attorney, Agent, or Firm* — The Belles Group, P.C.

(57) ABSTRACT

The invention relates to a ramp (2) for escape from passenger transport vehicles (1), said ramp (2) being foldable and, under normal working conditions, remaining folded and kept inside the vehicle (1), wherein the deployment of said ramp only requires manual actuation, and said ramp (2) comprises two portions (9, 10) that are connected by a hinge (18) and a mat (12) that is capable of supporting the passage of users, the mat (12) being made of two portions (12*a*) and (12*b*), each portion comprising a distal end (9*c*, 10*a*) hinged to one end of the gateway (12), respectively, and a proximal end (21*a*, 21*b*) connected to at least one cable (21).

7 Claims, 8 Drawing Sheets

ESCAPE RAMP

PRIORITY

Priority is claimed as a national stage application, under 35 U.S.C. §371, to PCT/IB2010/053110, filed Jul. 7, 2010, which claims priority to French Application No. 0903397, filed Jul. 9, 2009. The disclosures of the aforementioned priority applications are incorporated herein by reference in their entirety.

The present invention relates to a ramp intended for evacuating passenger transport vehicles, said ramp being foldable and, under normal working conditions, intended to remain folded and stay inside the vehicle and which requires no source of energy other than manual actuation to deploy it.

Such types of ramp are notably used in public transport, and in particular in certain underground metro trains to allow passengers to be evacuated onto the tracks. The cost of building underground tunnels means that the diameter of the tunnel is limited, leaving only a very small space between the metro train itself and the wall of the tunnel. In the event of evacuation, it therefore becomes very difficult for the passengers to leave the metro train via the lateral doors. In addition, because the floor of the metro train is around 1.20 m above the tracks, evacuation without some kind of escape device is difficult, particularly for those of reduced mobility.

Escape devices such as ladders already exist, but these devices are tricky to use and do not allow all individuals to be evacuated. There is therefore a need for an escape device that can be fitted at the front and rear end of the train and that will allow all of the passengers to be evacuated.

Such a device is described in document EP0776808. That document describes an escape door situated at the front end of a train and fitted with an unfoldable ramp that is folded during normal operation of the metro train. For evacuation purposes, the ramp can quickly be unfolded to allow all the passengers to be evacuated onto the track.

That device has made progress towards solving the problem but it still has a number of disadvantages. The need to allow the ramp to be deployed without any external supply of energy other than simply being pushed by a passenger manually has led to the floor of the ramp being folded at the top when the ramp is in the folded position. In the folded position, the ramp therefore occupies a significant amount of space at the top of the escape door. This is an impediment to tall passengers. In addition, the door cannot be fitted with a large window. Finally, the device is a special-purpose device difficult to install on existing metro trains.

There is therefore a need for an escape ramp which, in its folded position, occupies a smaller amount of space and is easier to fit to metro trains already in service.

According to the invention, a ramp intended for evacuating passenger transport vehicles, said ramp being foldable and, under normal working conditions, intended to remain folded and stay inside the vehicle and which requires only manual actuation to deploy it, said ramp comprising two parts connected by an articulation and a belt able to support the passage of users, characterized in that the belt is made in two parts, each part comprising a distal end which is respectively articulated to an end of the gangway and a proximal end which is connected to at least one cable.

Figure 1:
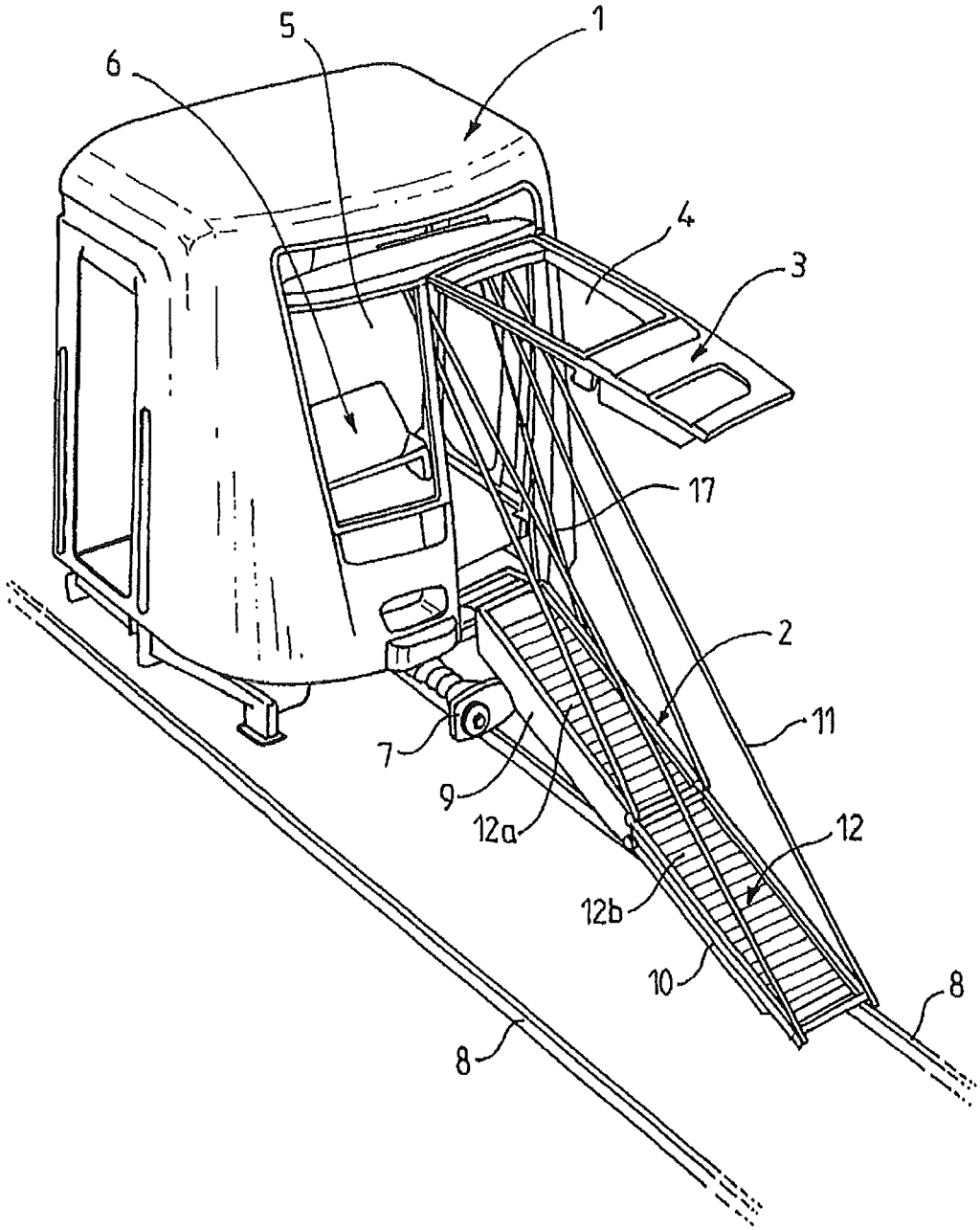
FIG. 1 is a perspective view of a ramp according to the invention mounted at the front of a metro train, the ramp being in the unfolded position.

FIG. 1 shows the front of a metro train 1 where a ramp 2 according to the invention is installed. The front of the metro train 1 comprises a door 3 fitted with a window 4, the door 3 being depicted in the open position. Beside the door 3 it is possible to see a windshield 5 and a driver's cab 6. The ramp 2 is deployed over a coupling device 7 and rails 8. It will be noted that the ramp 2 is designed so that, in the deployed position, its lowermost end is situated above the rails 8. In particular, it is considered that a distance of around 15 cm from the upper end of the rails 8 is a sufficient safety margin. This is because if, as it is deployed, the ramp 2 were to strike the rails 8 or the ground itself, the ramp 2 could become damaged.

The ramp 2 is made in two aluminum parts 9 and 10 articulated relative to one another. The ramp 2, considered in the deployed position, is articulated at its upper end to a mounting plate secured to the front of the metro train 1, at the base of the door 3 opening. Straps 11 are fixed firstly above the opening of the door 3 inside the metro train 1 and secondly to the lower end of the ramp 2 and to the articulation between the parts 9 and 10 of the ramp 2.

Figure 2:
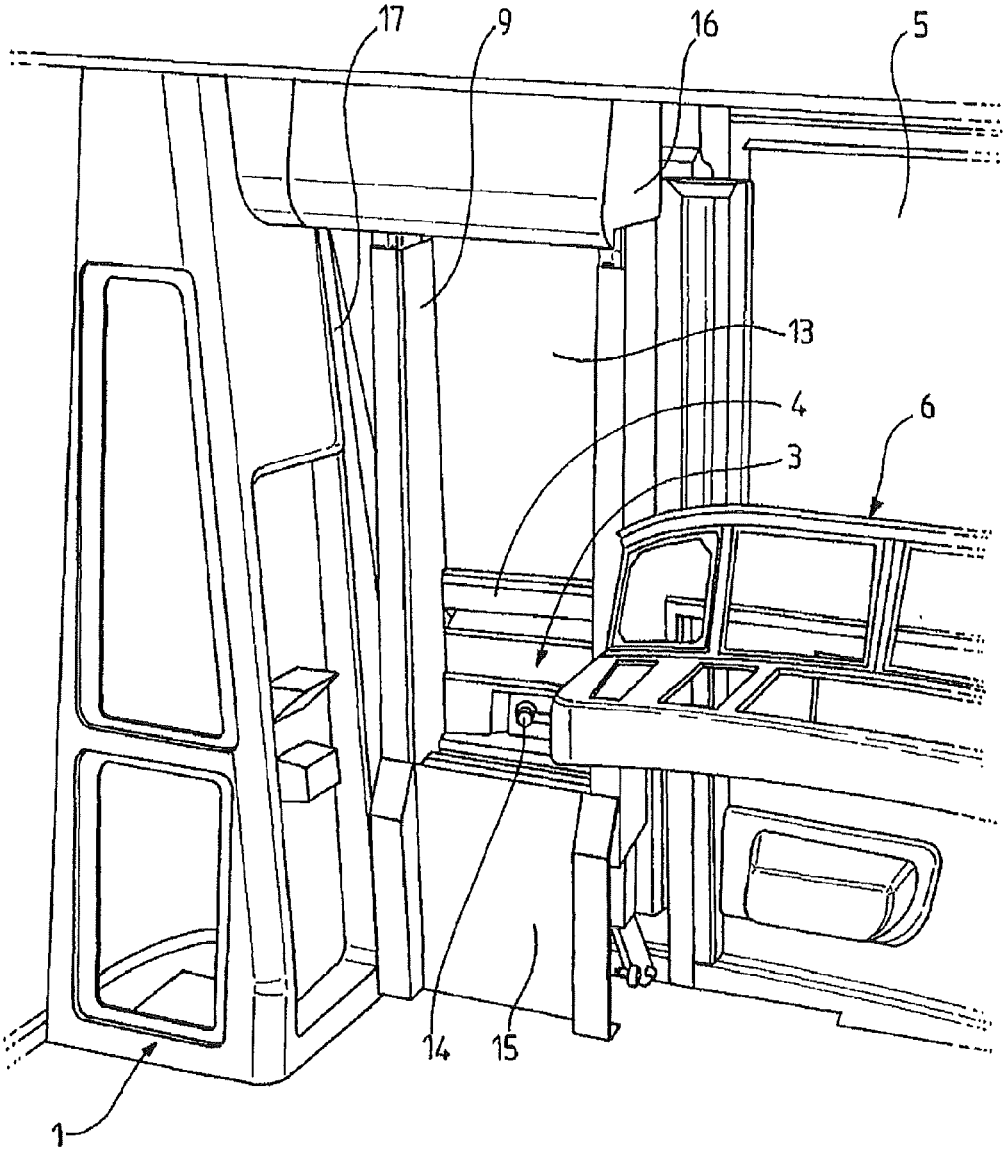
FIG. 2 is a perspective view, from inside the train, of the ramp of FIG. 1 in the folded position.

FIG. 2 shows the ramp 2 in situ from inside the metro train 1. It is possible to make out the driver's cab 6 and the windshield 5 and also the door 3 and its window 4 which is partially hidden behind the curtain 13. The ramp 2 can be seen in the folded position, particularly the part 9 thereof. The part 10 is itself hidden between the part 9 and the door 3.

It can be seen from FIG. 1 that the ramp 2 is deployed a long way forward so as to avoid any collision with the coupling device 7. As a result, as it deploys, a space remains between the floor of the metro train 1 and the ramp 2.

A gangway 15 is provided and is intended to fold down over this gap to allow for easy evacuation.

On the door 3, the handle of a locking device 14 is visible and accessible to the passengers, and this allows the door 3 to be opened in an emergency. It is therefore necessary that the ramp 2 in its folded position should not impede access to this handle 14.

The device for folding the ramp 16 can be glimpsed at the top, above the door 3 opening.

On the door 3 side, it is possible to see a double-acting gas cylinder 17 which prevents the ramp 2 from deploying too rapidly. A first end of the cylinder 17 is articulated to the structure of the metro train 1 near the door 3 hinge and the other end of the gas cylinder 17 is articulated to the ramp 2 on the part 9 side.

When the ramp is in the folded position, with the door closed, casings fixed to the ramp 2 conceal the belt 12 cable systems and the lubricated parts of the ramp 2. The belts 12 folded at the bottom will be hidden behind a horizontal casing fixed to the door 3 and by a step or gangway 15 which stands up vertically. The latter, mounted on hinges, is used to form a transition surface between the floor of the train 1 and the ramp 12.

The structure of the ramp 2 is more particularly visible in FIGS. 3 to 6.

Figure 3:
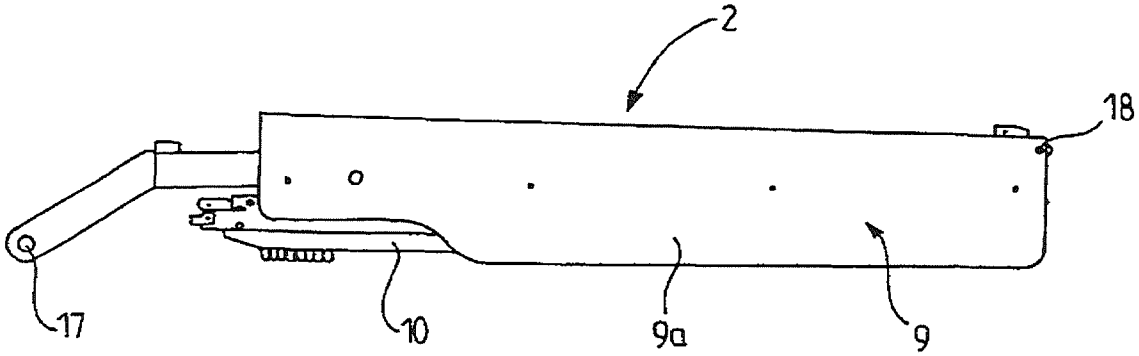
FIG. 3 is a side view of the ramp of FIG. 1 in the folded position.
Figure 4:
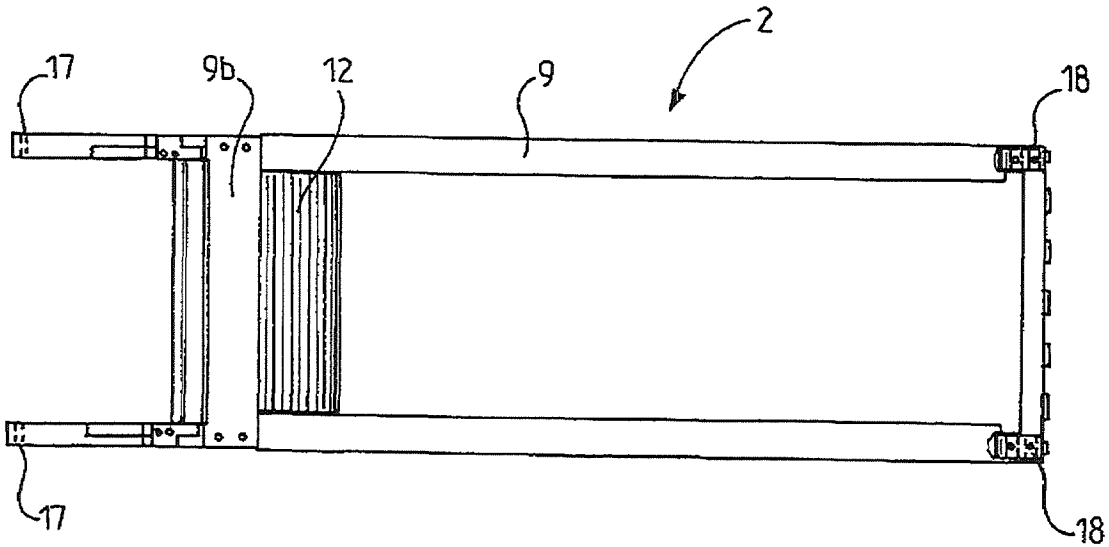
FIG. 4 is a plan view of the ramp of FIG. 1 in the folded position.

FIGS. 3 and 4 show the ramp 2 in its folded position.

FIG. 3 shows that the part 9 comprises a protective plate 9*a* intended to protect users from potential contact with harmful parts of the ramp 2.

The part 9 is formed of two parallel longitudinal members connected via a cross member 9*b*. The part 9 at one end has two orifices 17 intended to allow for articulation with the base of the door 3 opening of the metro train 1. The other end of the part 9 has an articulation 18 of the piano hinge type articulating it to the part 10 which is itself formed of two longitudinal members connected by cross members. A belt occupies the space between the two longitudinal members of the part 9. The belt 12 is made of a flexible Kevlar fabric reinforced by stainless steel cross members 19.

FIG. 4 shows the belt 12 in the folded position. Note the extremely small space that it occupies. FIG. 4 therefore shows the significant amount of space left between the longitudinal members of the parts 9 and 10 and the belt 12. This space means that a window 4 of considerable size can still be employed, thus improving the habitability of the metro train.

Figure 5:
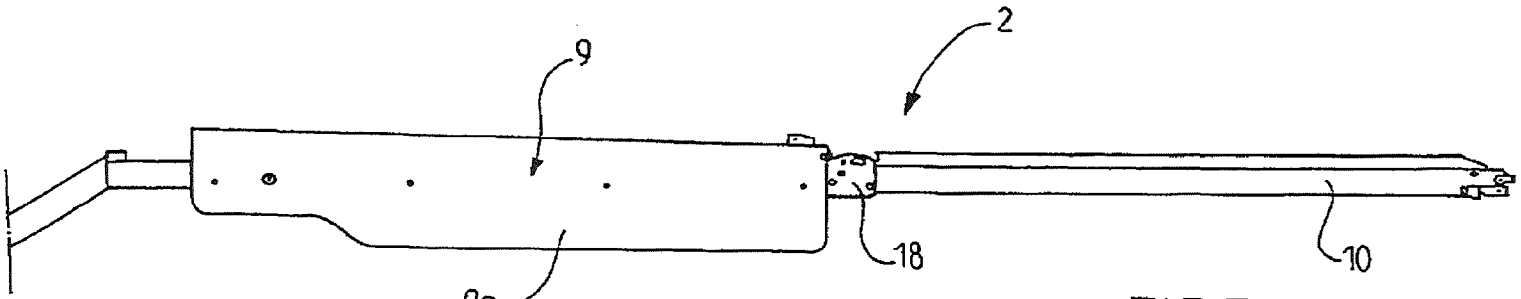
FIG. 5 is a side view of the ramp of FIG. 1 in the unfolded position.
Figure 6:
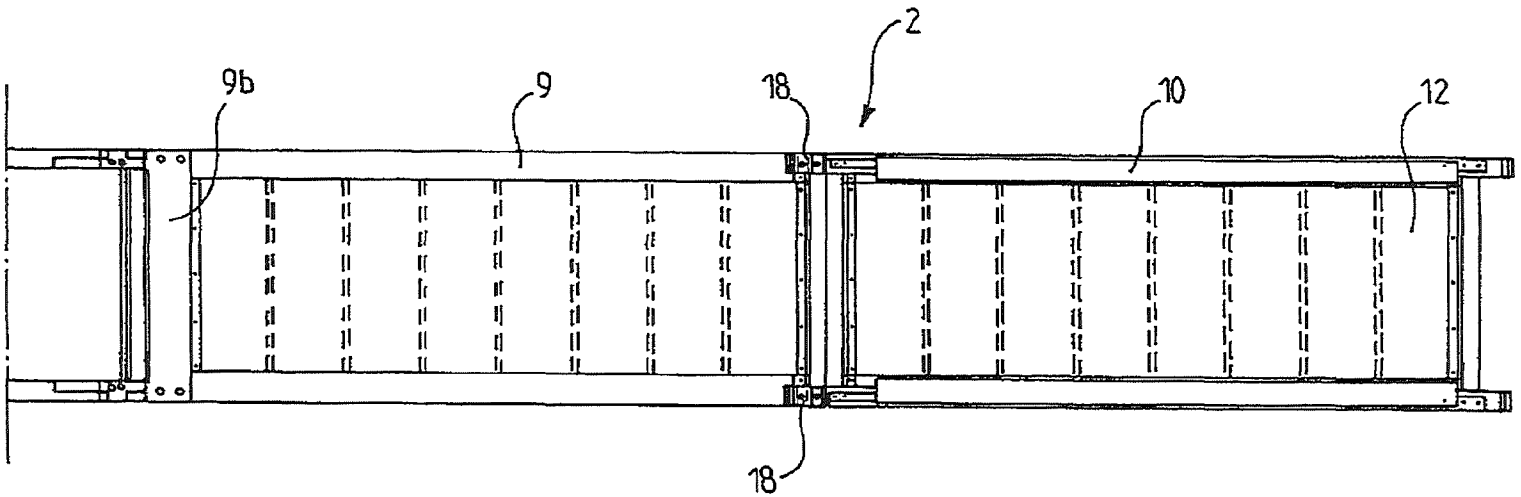
FIG. 6 is a plan view of the ramp of FIG. 1 in the unfolded position.

FIGS. 5 and 6 show the ramp 2 in the unfolded position. In addition to the elements already described, these figures show the belt 12 in the fully unfolded position thus allowing the passage of passengers. Note that the cross members 19 of the belt 12 slide on rails 20 housed in the longitudinal members and secured to said longitudinal members of the parts 9 and 10.

Figure 13:
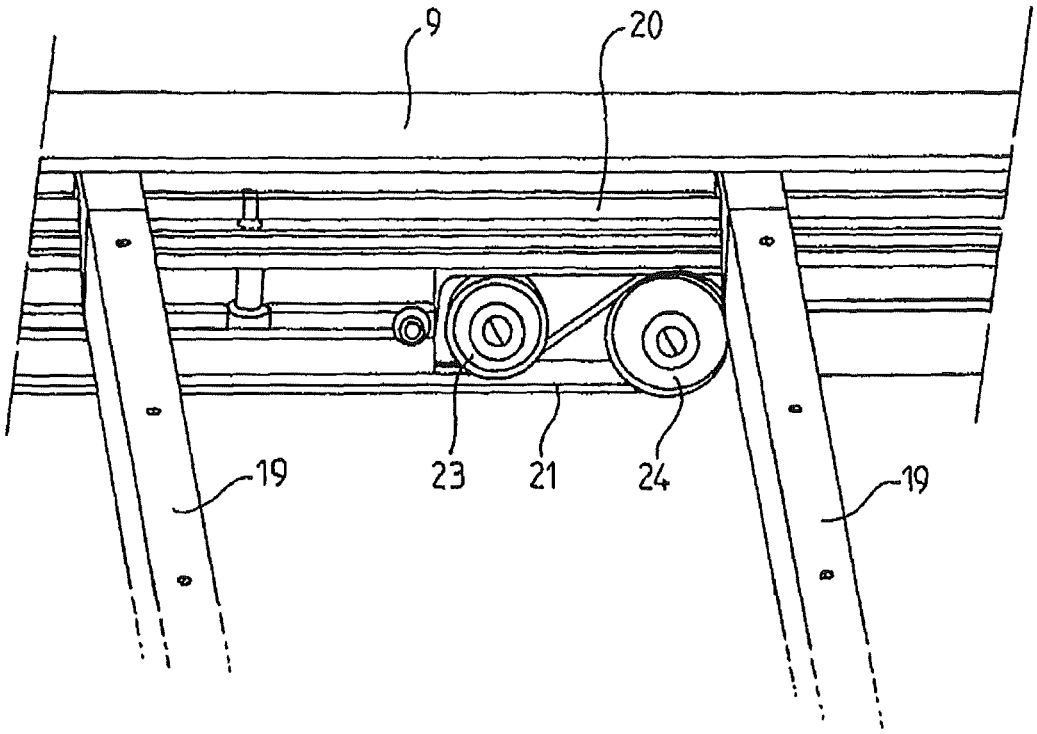
FIG. 13 is a detail illustrating how the cross members of the belt are guided on rails.

FIG. 13 shows the cross members 19 sliding on the rails 20. The Kevlar fabric of the belt 12 has not been depicted in FIG. 13.

The belt 12 is deployed using a cable 21. More precisely, two cables 21 are located in the longitudinal members of the parts 9 and 10. The paths of the cables 21 are identical and so the path of the cable that can be seen in FIG. 7 will be described.

The belt 12 is in two parts: a first part 12*a* which covers the half-gangway or part 9 and a second part 12*b* which covers the half-gangway or part 10. The first part 12*b* of the belt 12 is articulated to the half-gangway 9 near the articulation 17 to the floor of the metro train 1.

Thus it will be understood that, in the rest position, the belt 12 will be near the ground under the window 4. Likewise, the part 12*b* of the belt 12 is articulated to the half-gangway 10 near the end of the gangway 2. Thus, because at rest the articulation between the half-gangways 9 and 10 is at the top of the door 3 opening, it will be appreciated that the half-belt 12*b* will likewise be stored at the bottom under the window 4.

We have therefore seen that each of the two half-belts 12*a* and 12*b* have a first end articulated to the gangway 2. Each of the two half-belts 12*a* and 12*b* has a second end left free. These ends are connected by the cable 21.

Figure 7:
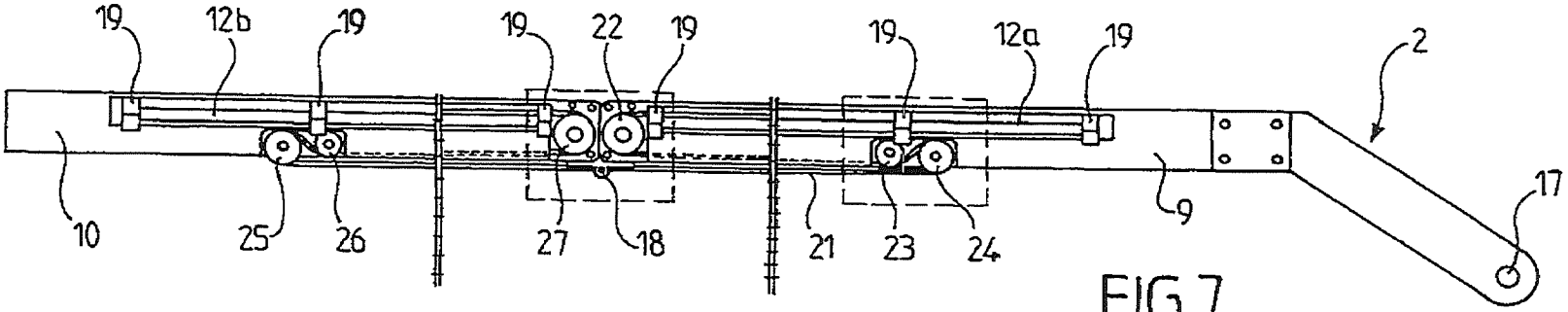
FIG. 7 is a view similar to FIG. 5 in cross section.
Figure 9:
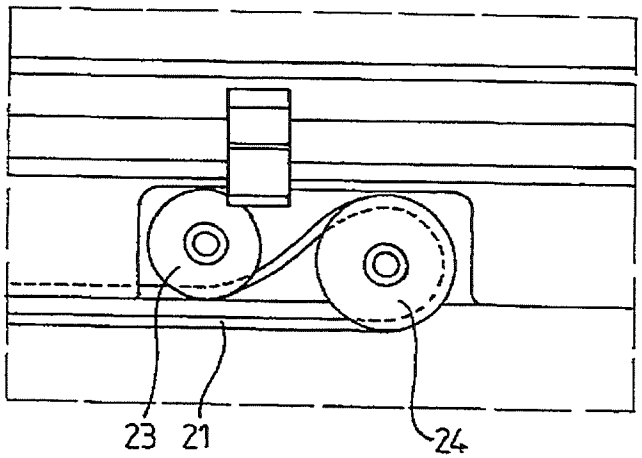
FIG. 8 and FIG. 9 are details of FIG. 7.
Figure 8:
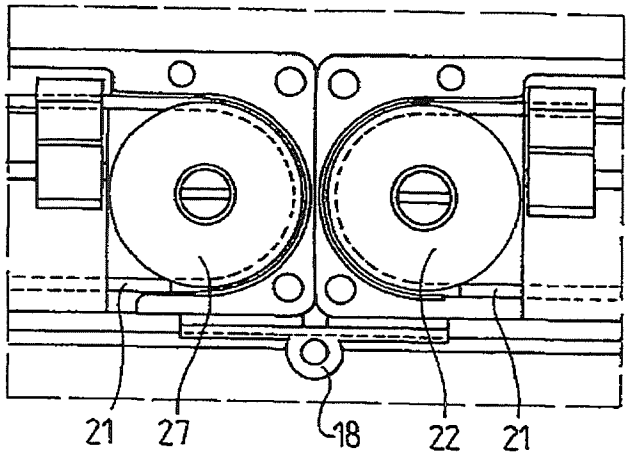

A study of FIG. 7 and, in particular, of the top of FIG. 7 in the right-hand part thereof, shows the part 12*a* of the belt 12. Its right-hand end will be fixed to the half-gangway 9 while its left-hand end will be driven by the cable 21. Said cable 21 is then guided over a first pulley 22 and then runs to the right in the bottom part of the half-gangway 9. It is then guided by the roller 23 and the pulley 24 as can be seen more particularly in FIG. 9. The cable 21 then extends to the left as far as the half-gangway 10. It is then guided via the pulley 25 of the roller 26 as far as the pulley 27 which lies near the articulation between the two half-gangways 9 and 10. After passing over the pulley 27, the cable reaches the half-belt 12*b* and is attached to the end thereof.

Figure 10:
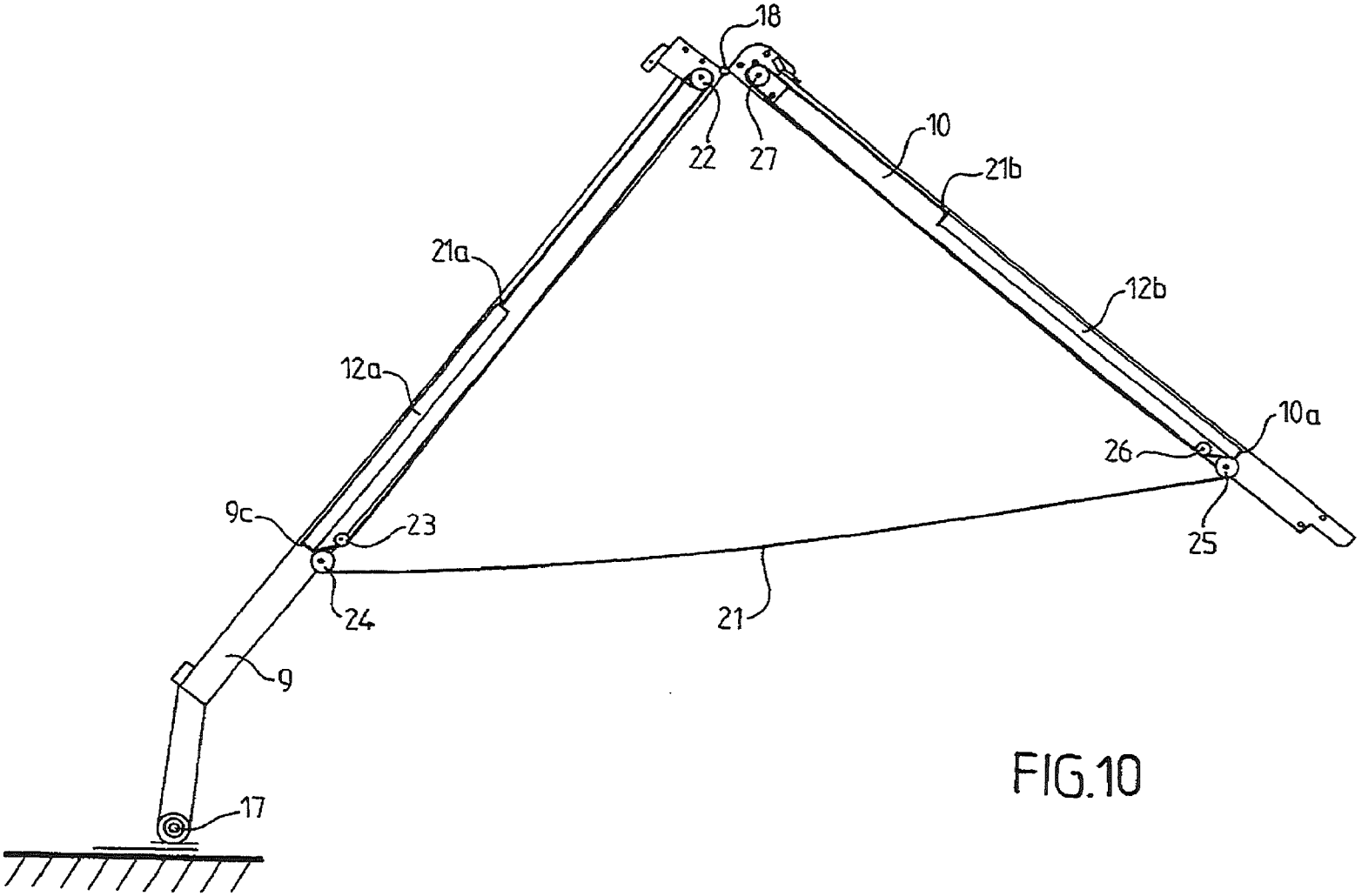
FIG. 10 is a side view of the ramp of FIG. 1 in a partially unfolded position.

FIG. 10 shows the gangway 2 in a part-folded position in which the cable 21 at its path are more particularly visible.

FIG. 10 more particularly shows the point of attachment 21*a* of the cable 21 to the half-belt 12*a* and the point of attachment 21*b* of the cable 21 to the half-belt 12*b*, and also the point of attachment 9*c* of the half-belt 12*a* to the half-ramp 9 and the point of attachment 10*a* of the half-belt 12*b* to the half-ramp 10.

Figure 12:
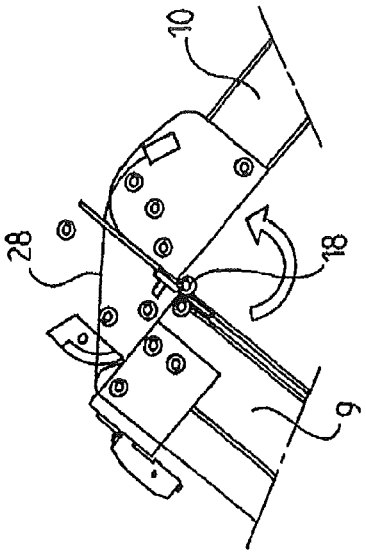
FIG. 12 is a detail of FIG. 11.
Figure 11:
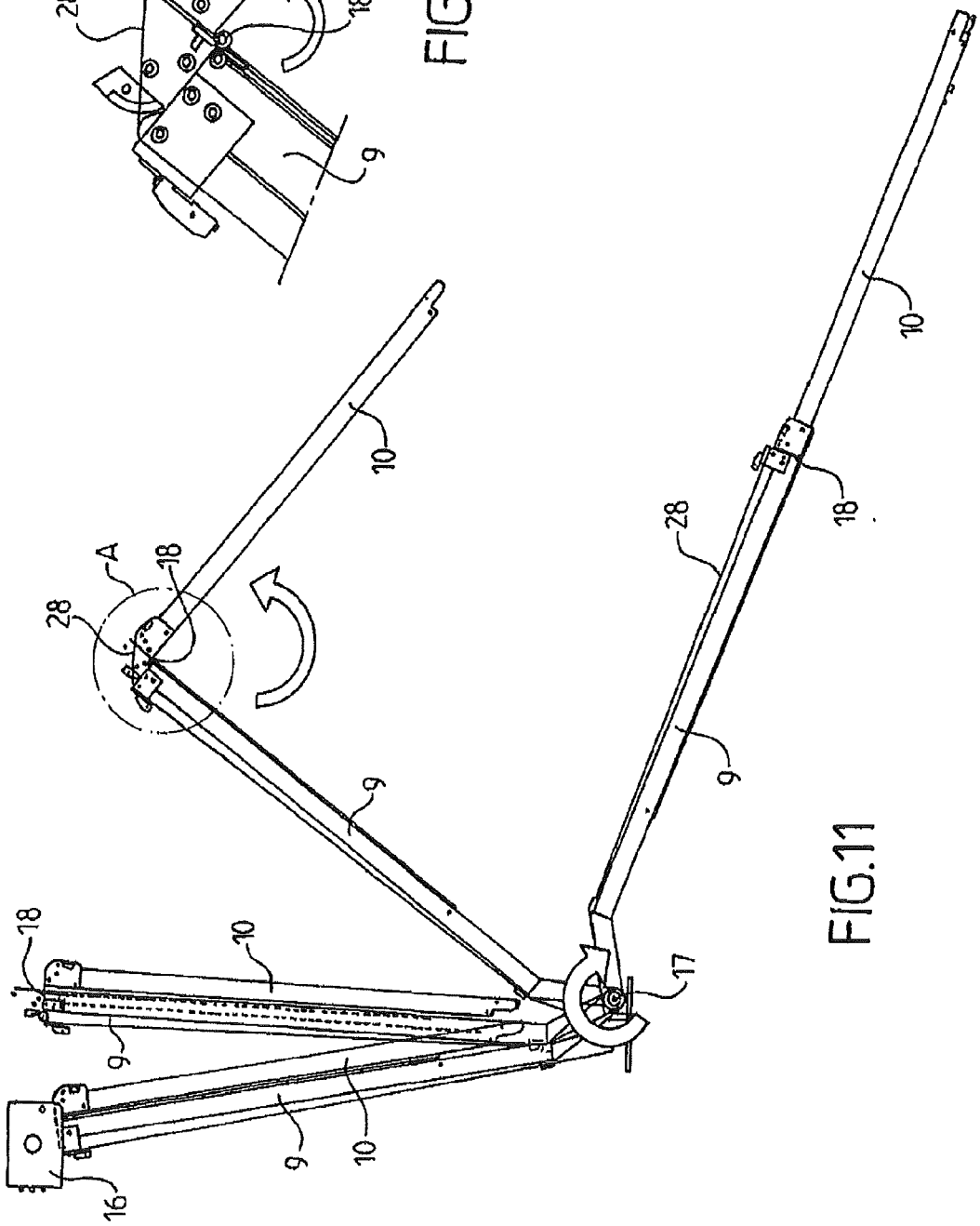
FIG. 11 is a view similar to FIG. 10 illustrating various phases of the deployment of the ramp.

FIGS. 11 and 12 more particularly illustrate the technique used to deploy the ramp 2. Specifically, it is necessary to provide reliable deployment of the half-parts 9 and 10. To do so, use is made of a cable 28 and of an already-proven technique. A first end of the cable 28 is secured to the chassis of the metro train 1 behind the articulation 17. The cable 28 then passes over the half-gangway 9 and is then guided by a set of pulleys 29 until it is attached to the end of the half-gangway 10 near the articulation 18.

In operation, having opened the front door 3, a passenger will apply around 20 kg of thrust to the rear of the ramp 2 and this will be enough to pivot it down toward the track.

Inertia and the boost cylinder 17 ensure that the ramp 2 deploys smoothly to the end. The cables 28 guarantee deployment of the half-ramp 10 while the cables 21 deploy the belt 12.

The total deployment time is under 10 seconds. Evacuation can then begin.

To fold the ramp 12, the support straps 11 fixed in the middle of the ramp 12 are mounted on a shaft with 2 pulleys. This shaft is fitted with a pinion which can be engaged by hand with a reduction gearbox. When the latter is engaged all that is required is for the reduction gearbox to be operated, for example using a drill fitted with a suitable bit, and the straps will gradually wind up and raise the ramp 2 in consequence. During folding, the belts 12 gradually return to their position at the bottom. At the end of folding, the boost cylinder 17 generates a retaining thrust on the ramp 12, and this prevents it from redeploying of its own accord.

The folding operation takes under 8 minutes and can be performed by a single person. The door 3 can then be closed.

One of the advantages of this solution is that of providing a belt in which the movement of the supporting cross members is guaranteed to be parallel. The tension in the cables between the two sides of the ramp will always be balanced because the length of the cables has been calculated so that these cables are always under tension during deployment. Pulleys built into the uprights of the two parts of the ramp prevent damage to these cables.

The use of cables, as opposed to purely inertial operation, limits the need to lubricate the cross members of the belt 12, and this reduces the amount of maintenance required.

The invention claimed is:

1. A ramp for evacuating a passenger transport vehicle, said ramp being foldable into an inside the vehicle, said ramp comprising two ramp parts connected by an articulation and a belt to support the passage of users, wherein the belt is made in two belt parts, each belt part comprising a distal end which is respectively articulated to an end of the ramp and a proximal end which is connected to at least one cable, wherein the at least one cable is connected to the proximal ends of each respective belt part and is always in tension between the proximal ends of each respective belt part during deployment, and wherein the at least one cable is configured to draw the proximal ends of each respective belt part toward a middle of said ramp during deployment, said ramp being configured to deploy by only manual actuation.

2. The ramp of claim 1, wherein a first part of the belt is articulated with a first of the two ramp parts in the vicinity of the articulation with the vehicle floor.

3. A ramp for evacuating a passenger transport vehicle, the ramp comprising:

first and second articulated ramp parts, wherein the first ramp part forms a first end of the ramp and is articulated to the vehicle, and the second ramp part forms a second end of the ramp and extends away from the vehicle during deployment;

a belt configured to support passengers, wherein the belt includes:

a first belt part, wherein a distal end of the first belt part is articulated to the first ramp part and a proximal end of the first belt part is in sliding engagement with the first ramp part; and a second belt part, wherein a distal end of the second belt part is articulated to the second ramp part and a proximal end of the second belt part is in sliding engagement with the second ramp part; and a belt cable, each end of the belt cable being coupled to one of the proximal ends of each respective belt part, wherein the belt cable is configured to remain in tension during deployment, and wherein tension in the belt cable causes the proximal ends of the first and second belt parts to slide toward a middle of the ramp during deployment.

4. The ramp of claim 3, wherein the belt cable is operatively coupled to the first and second ramp parts to maintain tension in the belt cable during deployment.

5. The ramp of claim 4, wherein the first and second ramp parts each include one or more pulleys configured to maintain tension in the belt cable during deployment.

6. The ramp of claim 3, wherein a distal end of the first belt part is articulated to the first ramp part at the first end of the ramp, and a distal end of the second belt part is articulated to the second ramp part at the second end of the ramp.

7. The ramp of claim 3, further comprising a deployment cable, wherein one end of the deployment cable is affixed to the vehicle, and the other end of the deployment cable is coupled to at least one of the ramp parts.

* * * * *